United States Patent [19]

Lintott

[11] Patent Number: 4,505,245

[45] Date of Patent: Mar. 19, 1985

[54] FUEL PUMPING APPARATUS

[75] Inventor: Edward R. Lintott, London, England

[73] Assignee: Lucas Industries plc, Birmingham, England

[21] Appl. No.: 391,963

[22] Filed: Jun. 24, 1982

[30] Foreign Application Priority Data

Jul. 4, 1981 [GB] United Kingdom ..... 8120720
Dec. 31, 1981 [GB] United Kingdom ..... 8139165

[51] Int. Cl.[3] ..... F02M 41/04
[52] U.S. Cl. ..... 123/451; 123/448
[58] Field of Search ..... 123/451, 448, 446

[56] References Cited

U.S. PATENT DOCUMENTS 1,232,258 7/1917 Evans ..... 123/451
1,657,373 1/1928 Danielson ..... 123/451
2,827,030 3/1958 Strumbos ..... 123/451

FOREIGN PATENT DOCUMENTS 210647 10/1940 Switzerland ..... 123/451

*Primary Examiner*—Charles J. Myhre
*Assistant Examiner*—Carl Stuart Miller

[57] ABSTRACT

A fuel pumping apparatus for supplying fuel to a multi-cylinder internal combustion engine includes a high pressure pump which supplies fuel in timed relationship with the engine. The fuel is distributed to fuel outlets in turn by means of an axially movable distributor member which has a groove connected to the high pressure pump and which can register with ports connected to the fuel outlets respectively. The distributor member is actuated by a lever means mounting rollers which engage cam profiles on a cup-shaped cam. The cam profiles are arranged such that the groove dwells at each port during the time fuel flows through the groove and port.

6 Claims, 6 Drawing Figures

FUEL PUMPING APPARATUS

This invention relates to fuel pumping apparatus for supplying fuel to a multi-cylinder internal combustion engine and of the kind comprising a pump plunger slidable within a bore, an outlet from said bore, a drive shaft rotatably mounted within a housing of the apparatus and arranged in use to be driven in timed relationship with an associated engine, first cam means carried by the drive shaft for imparting inward movement to the plunger, valve means for controlling the quantity of fuel displaced through said oulet during the inward movement of said plunger, a pair of fuel outlets in the housing connected in use, to fuel injection nozzles respectively of the associated engine, a distributor member mounted in the housing, drive means connecting the distributor member and the drive shaft whereby the distributor member operates in timed relationship to connect the outlet from the bore to said fuel outlets in turn during successive inward movements of the plunger.

Rotary distributor members are well known in the art but have disadvantages which are becoming increasingly apparent as the pressure at which fuel is supplied to compression ignition engines increases. The distributor member rotates continuously during the operation of the engine and is provided with a passage breaking out onto its peripheral surface and which registers with the outlet ports in turn, these ports opening into the bore into which the distributor member is located. The ports must be of a sufficient size to ensure that whilst fuel is being delivered by the high pressure pump, there is substantially no restriction to the flow of fuel. The port size must also be sufficient to take into account any timing variations which are effected at the high pressure pump. With the large ports and with increasing pressure, the leakage of fuel along the working clearance between the distributor member and the wall of the bore becomes an increasing problem.

The object of the invention is to provide an apparatus of the kind specified in a simple and convenient form.

According to the invention in a fuel pumping apparatus of the kind specified said drive means comprises further cam means carried by said shaft, a pair of rollers engaging said further cam means, lever means mounting said rollers, said lever means connecting with said distributor member whereby as the drive shaft is rotated axial movements will be imparted to the distributor member, said further cam means being arranged so that the distributor member during each revolution of the drive shaft connects the outlet from the bore to each of said fuel outlets in turn.

An example of a fuel pumping apparatus in accordance with the invention will now be described, with reference to the accompanying drawings, in which.

Figure 1:
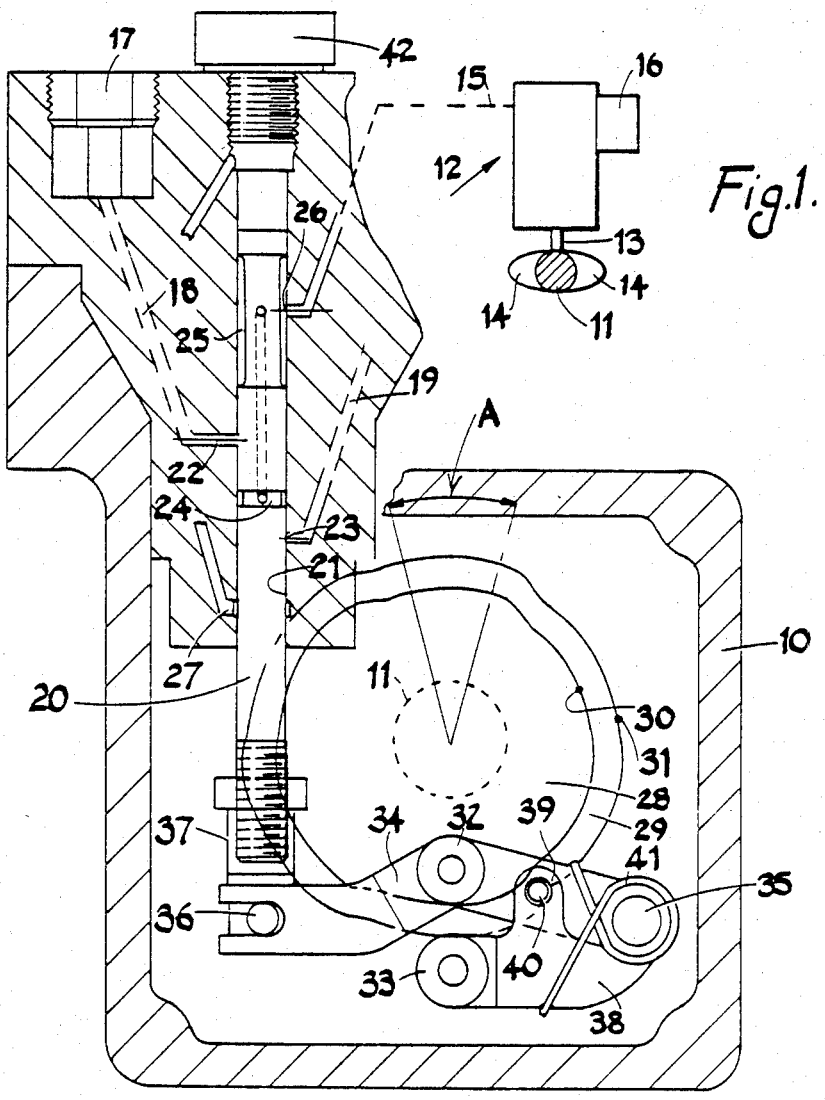
FIG. 1 is a diagrammatic side elevation of the apparatus.

Referring to the drawings the apparatus comprises a housing 10 in which is journalled a rotary drive shaft indicated at 11, the shaft in use, being coupled to the associated engine so that it is driven in timed relationship therewith. The apparatus includes an injection pump which is generally indicated at 12 and which comprises a plunger 13 which is reciprocably mounted within a bore not shown. The plunger is actuated by cam means comprising a pair of oppositely disposed cam lobes 14 carried upon the drive shaft 11. The injection pump includes an outlet 15 and valve means 16 which controls the amount of fuel supplied through the outlet each time the plunger is moved inwardly. It will be noted that because there are two cam lobes 14, fuel will be delivered through the outlet 15 twice per revolution of the shaft 11.

The pump is for supplying fuel to two cylinders of a compression ignition engine and the apparatus is equipped with a pair of fuel outlets one of which is shown at 17. The outlets communicate with a pair of passages 18, 19 defined in the housing of the apparatus and each fuel outlet may incorporate a non-return delivery valve of conventional construction. In order to distribute the fuel to the fuel outlets in turn, there is provided an axially movable distributor member 20 which is slidable within a bore 21 and which projects therefrom. The passages 18 and 19 open into the bore at axially spaced ports 22, 23 respectively and formed in the distributor member is a groove 24 which can be moved upon axial movement of the distributor member, into register with the port 22 of the port 23. The groove 24 by way of a passage within the distributor member, communicates with a further circumferential groove 25 which is in constant communication by way of a port 26, with the outlet 15 of the injection pump.

Adjacent the end of the bore from which the distributor member projects, is a groove 27 which is connected with a fuel drain (not shown) and also connected with the drain is the space defined at the opposite end of the bore, this being closed by a suitable plug 42.

With the parts in the position shown in the drawing, the plunger 13 is at the outer end of its bore and the position of the distributor member is such that the groove 24 is out of register with the ports 22 and 23. As the shaft 11 rotates the distributor member is moved axially in one direction or the other to place the groove 24 in communication with the appropriate one of the ports 22 and 23. Following this movement the plunger can be moved inwardly so that fuel displaced through the outlet 15 will flow to the appropriate injection nozzle.

In order to effect movement of the distributor member there is provided on the shaft 11, a cup-shaped skirt 29. The skirt 29 defines inner and outer cam surfaces 30, 31 respectively and for engagement with the surfaces there is provided a pair of rollers 32, 33. The roller 32 is mounted upon a cranked lever 34 which is pivotally mounted about a pivot post 35 and at its opposite end it is formed for engagement with a pin 36 which is carried by a forked member 37 which is adjustedly mounted upon the distributor member 20. The roller 33 is carried by a further lever 38 also mounted about the pivot post 35. The lever 38 has a projection 39 which is provided with an aperture and located with clearance within this aperture is a pin 40 which is carried by the lever 34. In addition, a torsion spring 41 is provided and which acts upon the levers 34 and 38 in the direction to urge the rollers into contact with the cam surfaces respectively.

The rim 29 and in particular the cam surfaces 30 and 31 are shaped so that as the cam is rotated, the required movement will be imparted to the distributor member 20. In the example, the cam is shaped to define two "dwells" one of which is indicated by the arrow "A" in FIG. 1. The dwells when the rollers are in engagement therewith, correspond to the position of the distributor member in which the groove 24 is out of register with the ports 22 and 23. As the shaft 11 is rotated the distributor member will be moved firstly in one axial direction so that for example the groove 24 is brought into register with the port 22 followed by a short dwell period during which delivery of fuel takes place, and is then returned to the intermediate position. Continued rotation of the shaft effects movement of the distributor member in the opposite direction to bring the groove 24 into register with the port 23.

The period of dwell during which delivery of fuel can take place is important since it enables the circumferential groove 24 and also the ports 22 and 23 to be of the minimum width necessary to cater for the volume of fuel between the outlet 15 from the bore of the injection pump and the fuel outlet 17 can be reduced to a minimum. The purpose of the spring 41 is to maintain the rollers 32 and 33 in contact with the respective cam surfaces and to accommodate any small differences in the thickness of the rim of the cam due to machining tolerances. The pin 40 is provided to limit the extent of relative movement of the levers 34 and 38 particularly when the cam surface 31 operates to impart to the roller 33 movement to move the distributor member 20 downwardly.

The constructions in which the distributor member moves either axially or in a rotary manner all the time the drive shaft is rotating, the ports and/or groove have to be larger than is required to cope with the maximum fuel flow, in order to ensure that substantially no restriction to the flow of fuel takes place.

Figure 2:
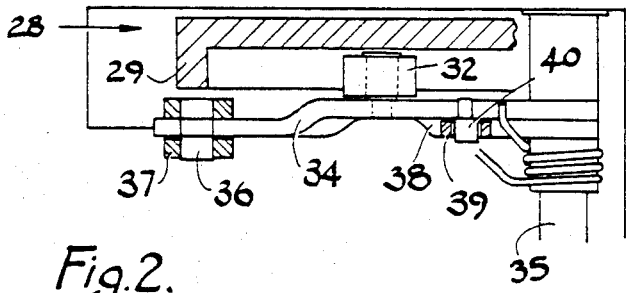
FIG. 2 is a plan view of a portion of the apparatus shown in FIG. 1.
Figure 3:
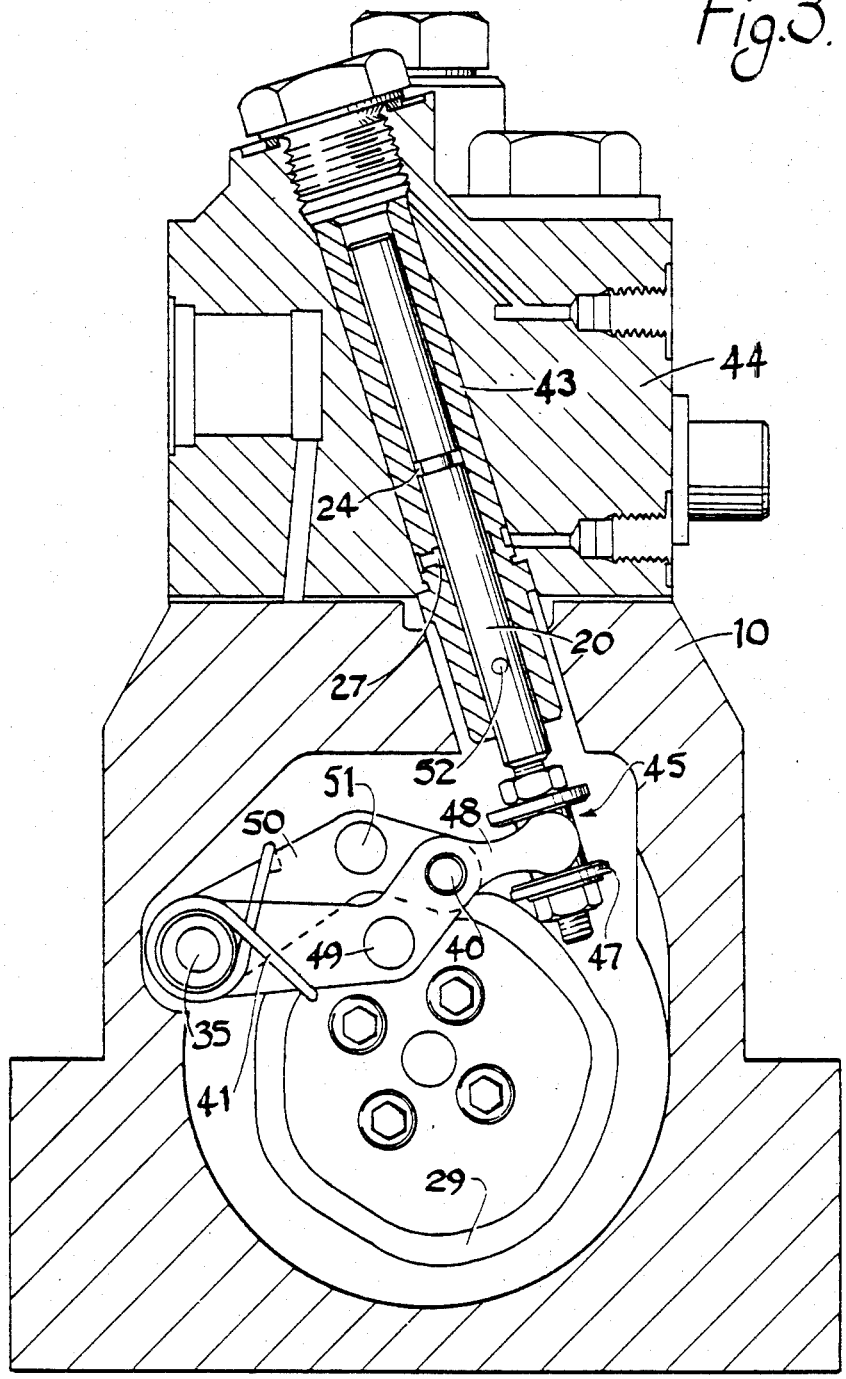
FIG. 3 is an alternative form of the apparatus.

A modified form of the apparatus is seen in FIG. 3 in which the same reference numerals are used for those parts which have the same function as the equivalent parts in FIGS. 1 and 2.

It will be noticed that the lever mechanism is disposed at a different position within the housing and that the axis of movement of the distributor member is inclined. The practical effect of this modification is that the inertia of the distributor member is reduced. The distributor member is located within a sleeve 43 located in a bore in a housing part 44 secured to the main housing portion 10.

The distributor member is adjustably connected to a collar 45 defining a pair of spaced flanges 47 and between the flanges is located the bifurcated end of a lever 48 corresponding to the lever 34, the lever is pivotally mounted about the pivot post 35 and carries a roller 49 which is engaged with the inner cam profile. The post 35 carries another lever 50 which mounts a roller 51 engaging with the outer cam profile. The spring 41 acts to bias the levers so that the rollers engage the respective cam profiles and the lever 50 carries the pin 40 located in the aperture in the lever 48.

The distributor member is restrained against angular movement by means of a pin 52 which in use slides within a groove (not shown) in a portion of the sleeve 43 which projects from the housing part 44.

Figure 4:
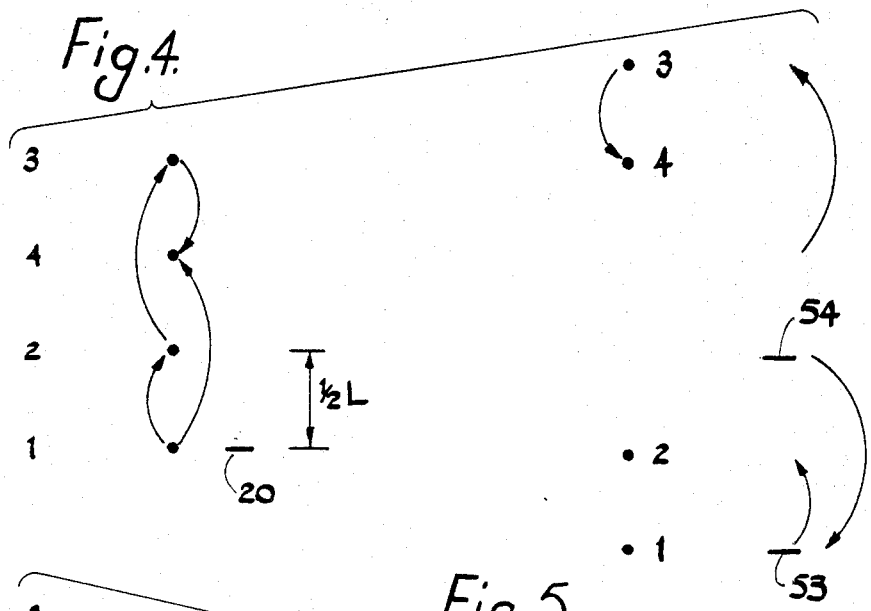
FIGS. 4, 5 and 6 are diagrams showing the disposition of ports and grooves incorporated in the apparatus of FIGS. 1 and 3.

In order to reduce the forces experienced by the actuating mechanism for the distributor member, the profiles of the cam are arranged in a manner so that when moving between one port and another, the distributor member moves at a maximum, twice the distance between the outlet ports. This will be explained in the case of a four cylinder engine, with reference to FIG. 4. In FIG. 4, the outlet ports are shown numbered 1, 2, 3 and 4 it being understood that these numbers do not correspond to the conventional numbering of the engine cylinders. In the left-hand diagram of FIG. 4, a single groove is formed in the periphery of the distributor member this being assigned the reference numeral 24 corresponding to FIG. 1. As shown in groove is in register with port number 1 and when the delivery of fuel to this port has ceased, the distributor member is moved axially so that the groove is brought into communication with the port 2. This movement is referred to as ½ lift (L). This corresponds to the axial spacing between adjacent ports. The next movement carried out by the distributor member is twice the previous movement to bring the groove 24 into register with port number 3. This movement is equal to a full lift and in order to reach port number 4 the distributor member is moved in the opposite axial direction by one ½ lift. Finally in order to bring the groove 24 back into communication with port number 1 the distributor member undergoes a full lift.

It is possible to provide two grooves on the distributor member and to deliver fuel to a four cylinder engine. This arrangement is shown in the right-hand diagram of FIG. 4, the grooves being indicated by the reference numerals 53, 54 respectively. As shown groove 53 is in register with port number 1 while groove 54 is of course out of register with the ports. The first movement of the distributor member is a ½ lift movement to bring the groove 53 into communication with port number 2. During this movement the groove 54 clearly moves by the same amount and the next axial movement imparted to the distributor member is a full lift to bring the groove 54 into communication with port 3. Finally the distributor member is moved in the opposite direction firstly by a ½ lift movement to bring groove 54 in communication with port number 4 and then a full lift movement to bring groove 53 into communication with port number 1. Again it will be noticed that the maximum movement imparted to the distributor member is a full lift movement, and the cam profiles for the two arrangements are the same. The advantage of using two grooves is that the ports can be divided into two axially spaced groups.

Figure 5:
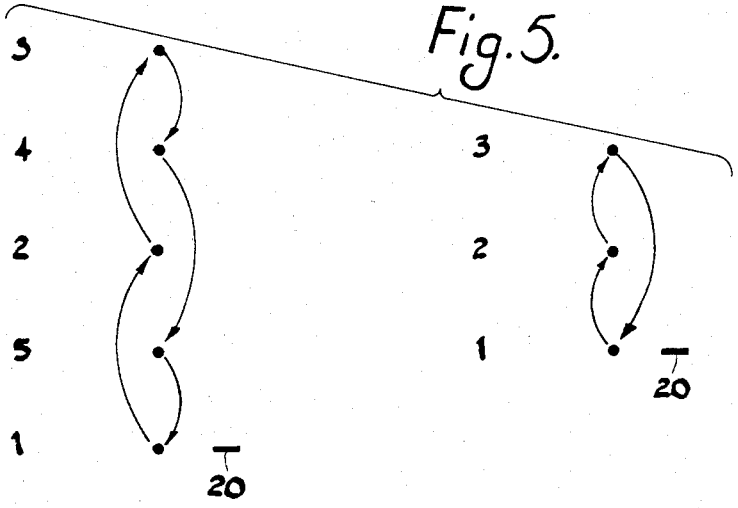

In FIG. 5 there is shown the movement imparted to the distributor member in order to supply fuel using a distributor member with a single groove 20 to, in the case of the left-hand diagram, a five cylinder engine and, in the case of the right-hand diagram, a three cylinder engine. Again it will be observed that the maximum movement imparted to the distributor member corresponds to the full lift that is to say twice the spacing between adjacent ports.

There would be little point in using two grooves to supply fuel to a three cylinder engine but it is possible to supply fuel to a five cylinder engine using two grooves. The cam profiles are the same as when a single groove is employed.

Figure 6:
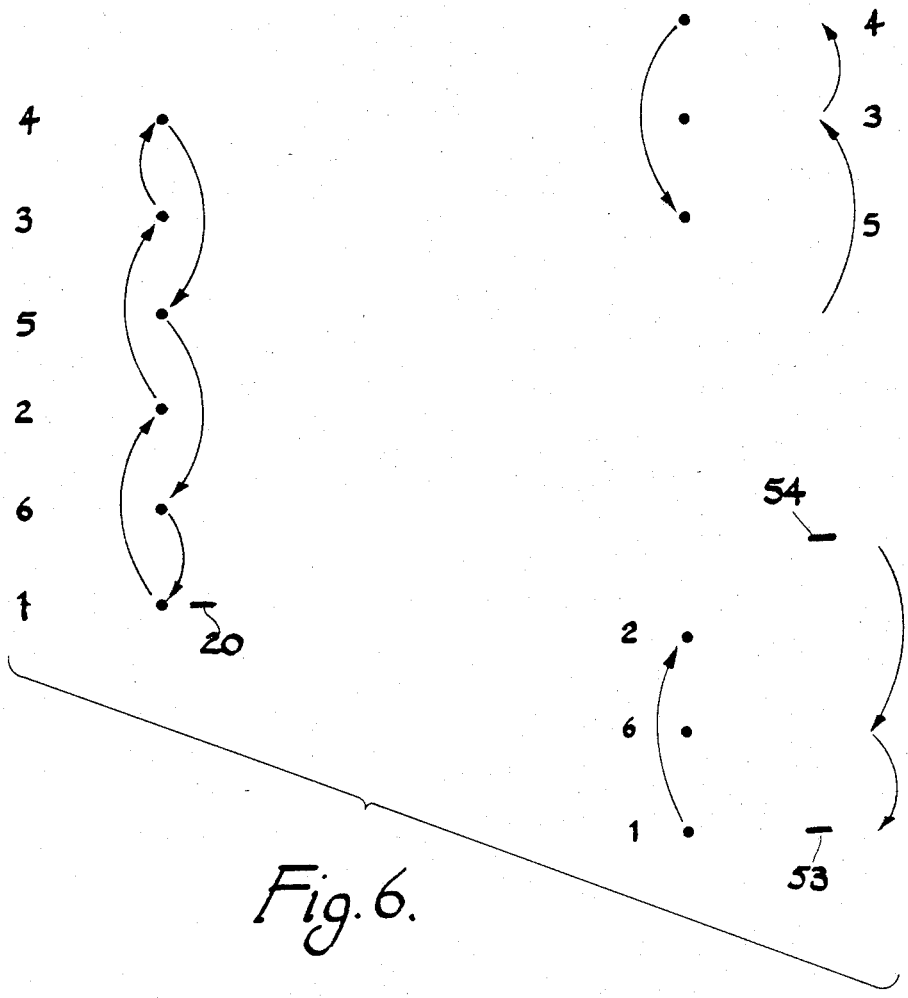

In FIG. 6 there is shown in the left-hand diagram the movement of the distributor member when the engine is a six cylinder engine and when the distributor member has a single groove. The right-hand diagram again refers to a six cylinder engine but in this case the distributor member has two grooves. As with the four cylinder engine, the cam profiles are the same.

With the axial movement of the distributor member as described the range of movement of the distributor member in each axial direction is equal to half the number of ports minus a half where the distance between adjacent ports equal ½ lift. It will be understood that in moving from one port to the next port to distribute the fuel, the distributor member moves no more than one lift that is to say twice the distance between adjacent ports and that for each revolution of the cam the distributor member on two occasions moves through a distance equal to ½ lift.

I claim:

1. A fuel pumping apparatus for supplying fuel to a multi-cylinder internal combustion engine comprising a pump plunger slidable within a bore, an outlet from said bore, a drive shaft rotatably mounted within a housing of the apparatus and arranged in use to be driven in timed relationship with an associated engine, first cam means carried by the drive shaft for imparting inward movement to the plunger, valve means for controlling the quantity of fuel displaced through said outlet during the inward movement of said plunger, a pair of fuel outlets in the housing connected in use, to fuel injection nozzles respectively of the associated engine, a distributor member mounted in the housing, drive means connecting the distributor member and the drive shaft whereby the distributor member operates in timed relationship to connect the outlet from the bore to said fuel outlets in turn during successive inward movements of the plunger, said drive means comprising further cam means carried by said shaft, a pair of rollers engaging said further cam means, said further cam means defining a pair of opposed cam profiles, said rollers engaging said cam profiles respectively, a pair of levers mounting the rollers respectively, a pivot post about which the levers can pivot, means adjustably mounted on the distributor member and engaged by one of said levers, a pin carried by one of the levers and an aperture in the other lever, said pin being located in said aperture but being slightly smaller than said aperture to allow limited relative movement of the levers, and resilient means acting on the levers in a direction to urge the rollers into contact with the respective cam profiles, whereby as the drive shaft is rotated axial movement will be imparted to the distributor member, said further cam means being arranged so that the distributor member during each revolution of the drive shaft connects the outlet from the bore to each of said fuel outlets in turn.

2. An apparatus according to claim 1, in which said further cam is of cup-shaped form, the skirt of the cam defining said cam profiles.

3. An apparatus according to claim 2, in which said cam profiles are shaped such that the distributor member is at rest during the time fuel is displaced from the bore to a fuel outlet.

4. An apparatus according to claim 3, including a circumferential groove on said distributor member, said groove communicating with the outlet from said bore, said fuel outlets communicating with ports respectively opening onto the periphery of the distributor member.

5. An apparatus according to claim 4 in which said ports are equi-axially spaced.

6. An apparatus according to claim 3, including a groove or grooves on the distributor member, said groove or grooves communicating with the outlet from said bore, said fuel outlet from said bore, said fuel outlets communicating with portsrespectively opening into the periphery of the distributor member, said ports being divided into groups equal to the number of grooves, said cam profiles being arranged so that each port is visited by a groove once per revolution of the cam, the cam profiles being shaped so that in moving between one part and the next port to receive fuel, the maximum distance the distributor can move is equal to twice the axial distance between adjacent ports of a group and during one revolution of the cam, the distributor member moves on two occasions a distance equal to said axial distance.

* * * * *